US006408627B1

(12) United States Patent
Batton et al.

(10) Patent No.: US 6,408,627 B1
(45) Date of Patent: Jun. 25, 2002

(54) INTEGRATED CONTINUOUS POWER SYSTEM ASSEMBLIES

(75) Inventors: William D. Batton, Arvada; Kevin Hotton, Broomfield; Gary Frey, Morrison; Gail Roberts, Arvada, all of CO (US)

(73) Assignee: Active Power, Inc., Austin, TX (US)

( * ) Notice: Subject to any disclaimer, the term of this patent is extended or adjusted under 35 U.S.C. 154(b) by 0 days.

(21) Appl. No.: 09/861,961

(22) Filed: May 21, 2001

(51) Int. Cl.[7] ..... F01K 13/02

(52) U.S. Cl. ..... 60/646; 60/657; 60/659; 122/35

(58) Field of Search ..... 60/646, 657, 659; 122/35

(56) References Cited

U.S. PATENT DOCUMENTS 1,758,474 A * 5/1930 Seehaus ..... 122/35 X
1,781,836 A * 11/1930 Flatt ..... 122/35
1,959,286 A * 5/1934 Grebe ..... 122/35
4,771,763 A * 9/1988 Wetzel, Jr. ..... 126/433
5,315,938 A * 5/1994 Freller ..... 122/35 X
6,192,687 B1 * 2/2001 Pinkerton et al. ..... 60/646
6,255,743 B1 * 7/2001 Pinkerton et al. ..... 290/40 C

* cited by examiner

*Primary Examiner*—Hoang Nguyen
(74) *Attorney, Agent, or Firm*—Fish & Neave; Robert W. Morris; Andrew Oliver

(57) ABSTRACT

A continuous power system accumulator assembly is provided that stores thermal energy as sensible heat and minimizes the amount of thermal energy wasted by the system. The assembly includes an accumulator at its core. A preheater assembly is wrapped around the accumulator such that it may absorb heat radiated and conducted from the accumulator. An evaporator is wrapped around the preheater so that most of the heat that is radiated and conducted from the preheater is utilized to heat the vaporizer. The outer housing of the assembly may be a double-walled housing having a layer of insulation located between the two walls. This configuration minimizes heat losses by the assembly.

31 Claims, 1 Drawing Sheet

INTEGRATED CONTINUOUS POWER SYSTEM ASSEMBLIES

BACKGROUND OF THE INVENTION

This invention relates to continuous power systems. In particular, the present invention relates to continuous power systems that utilize a source of stored thermal energy to provide a continuous supply of electric power when a primary power supply fails, or when deterioration occurs in the power being supplied to the end user.

Continuous power systems are often used to insure that, when a primary power supply fails due to equipment malfunction, downed lines or other reasons, electric power will continue to be supplied to critical loads such as telecommunication systems, because, for example, telecommunication systems often include facilities that may be in relatively isolated locations, such as a telecommunication repeater tower. Other applications of the present invention include hospital operating room equipment, computer systems and computerized manufacturing equipment. Continuous power systems avoid equipment failures, costly downtime and equipment damage.

Known continuous power systems may employ an uninterruptible power supply (UPS) to provide alternating current (AC) power to the end user or critical load, or may use other electronic means to provide DC power to the end user or critical load.

For known continuous power systems, batteries or flywheels may be employed as energy storage subsystems to provide bridging energy while a fuel-burning engine is started. Such flywheel systems may include a flywheel connected to an electrical machine that can operate both as a motor and a generator. For example, U.S. Pat. No. 5,731,645 describes flywheel systems that provide backup power to the load in UPS systems. The electrical machine is powered by a DC buss to operate as a motor when acceptable power is received from the primary power supply. When power from the primary power supply fails (or is degraded), the electrical machine is rotated by the kinetic energy of the flywheel and operates as a generator to supply power to the DC buss.

Continuous power systems often use prime movers (e.g., fuel-burning engines) to drive backup generators during prolonged power outages. These prime movers, however, are often costly, complicated, and may require extensive ongoing maintenance. In addition, the engines themselves may fail to start, resulting in a loss of power to the critical load. Moreover, some localities limit the running time or the number of starts per year for backup generator engines, thereby limiting the ability to test and maintain such systems.

Other energy storage systems currently used to provide backup power are often expensive and complicated. For example, in typical battery energy storage systems, there is a risk that undetected battery damage or corrosion of battery terminals can result in a failure to deliver backup power when needed. Moreover, batteries have a limited shelf life, in addition to requiring expensive ventilation, drainage, air conditioning and frequent maintenance. Flywheel energy storage systems, while avoiding most of the disadvantages of batteries, can be expensive since they are often mechanically complex and can require complicated power electronics.

Some known systems provide long-term power by driving a shaft-mounted generator with a turbine. For example, U.S. Pat. No. 6,255,743 (Application No. 09/318,728) describes an uninterruptible power supply system that includes a shaft-mounted generator and a turbine. These turbines may be open systems, where the turbine is driven by a fuel source that is regularly renewed, such as LP gas, methane, gasoline, diesel fuel. In such instances, the turbine exhaust is allowed to escape into the environment.

Other turbine systems, however, may be closed or partially-closed systems. In such systems, some or all of the turbine exhaust is recaptured by the system for later use. For instance, in a partially-closed system that is steam powered, the system may be configured to recapture a portion of the steam that is exhausted from the turbine. The system may then condense the steam (using a condenser or through natural cooling) into water prior to reheating, revaporizing and reusing the steam to drive the turbine.

In most closed systems, substantially all of the working fluid is condensed prior to reuse. The condensation is usually accomplished by using a condenser that cools the gas to a temperature at which the gas condenses into liquid form. In some systems, some of the liquid working fluid can be stored in a device, such as an accumulator, as heated or superheated liquid which can be evaporated and used to drive the turbine by use of its stored sensible heat.

Another concern with turbine systems relates to system efficiency. In such systems, it is often desirable to reuse thermal energy to the extent possible, rather than lose the energy to the environment. Accordingly, closed turbine systems can be arranged with an accumulator, preheater and evaporator interconnected so that working fluid is passed from one component to another throughout the whole system. These separate components, however, are not able to share significant amounts of stored heat energy. Rather, heat energy is often lost via radiation into the environment, other machinery, or even as the working fluid passes through the system.

Accordingly, it is an object of the present invention to provide continuous power system assemblies that reduce stored thermal energy losses.

It is another object of the present invention to provide continuous power system assemblies that utilize a single source of thermal energy to heat multiple components.

It is a further object of the present invention to provide components of a continuous power system that may be used as a source of stored thermal energy for short-term backup power needs.

SUMMARY OF THE INVENTION

The continuous power system assemblies of the present invention efficiently utilize thermal energy by minimizing overall heat loss. In particular, the assemblies of the present invention include an integrated unit that contains an accumulator and a preheater/evaporator for use with a turbine. The accumulator is used to store hot liquid working fluid prior to vaporization and injection into the turbine. The working fluid may, in accordance with the present invention, be preheated to a predetermined temperature by a heating element, such as a resistor assembly, that is immersed in the working fluid.

The accumulator is, in accordance with the present invention, located in the core of the integrated assembly. A series of preheater coils surround the accumulator housing, and are heated by thermal energy that is lost by the accumulator. A series of evaporator coils surround and are connected to the preheater coils. The evaporator coils may also be heated by thermal energy that escapes from the accumulator housing.

The preheater and evaporator coils are contained in an additional housing that includes a port for the introduction of heated gas from an external source, such as a fuel burning furnace. The preheater/evaporator housing is surrounded by an assembly housing, and a layer of insulation is located between the two housings to further minimize thermal energy losses by the assembly.

Thus, the present invention provides for the efficient storage of heat energy by surrounding the accumulator with the preheater and/or evaporator so that heat lost by the accumulator is used by other assembly components. Moreover, the heat energy lost by the accumulator may be more easily captured and utilized by the preheater and evaporator by thermally insulating the entire assembly, thereby minimizing heat energy losses to the environment.

In accordance with the methods of the present invention, an electric heating element (or other known heating device) is placed in good thermal contact with the accumulator. This heating element may be referred to simply as the "accumulator heater," and may be driven by power sources other than electricity. The accumulator heater may be used to heat the liquid inside the accumulator during STAND-BY mode (i.e., when the power grid, or utility power, is providing sufficient power at a sufficient quality to the load).

During STAND-BY mode, it may be desired to seal the liquid in the accumulator from the other parts of the continuous power system. This may be accomplished, for example, by using valves. Preventing substantial flow of liquid into and out of the accumulator allows the accumulator heater to heat the liquid in the accumulator to a desired temperature and pressure (because the accumulator is likely sealed) for operation with the turbine when utility power becomes insufficient for the load, due to either quantity or quality.

Once the degradation of power is detected and such other stores of energy as may exist are at predetermined levels, the system switches to RUN mode, and the liquid in the accumulator is released by valve into the preheater and evaporator to power the turbine. It should be noted that an OUTAGE, as defined herein, includes both an interruption in power from a source (such as utility power), as well as a degradation in quality of the power delivered by the source. This includes both SHORT-TERM—in terms of seconds or minutes, and LONG-TERM, or EXTENDED OUTAGES (e.g., lasting hours, days, or even weeks).

It may be advantageous for the accumulator of the present invention to be a substantially cylindrical container. The accumulator heater may be an electric heating element that is placed inside of the accumulator and may be integral with the accumulator. The preheater and evaporator components may be formed as a coiled tube heat exchanger designed to heat a liquid, such as toluene, to a superheated vapor state. While the preheater of the present invention is shown wrapped helically around the accumulator and the evaporator is shown wrapped helically around the preheater, alternative arrangements, such as longitudinally arranged tubing sections, may be used.

BRIEF DESCRIPTION OF THE DRAWING

Further features of the invention, including the above and other objects and advantages of the present invention, will be apparent upon consideration of the following detailed description, taken in conjunction with accompanying drawing in which.

DETAILED DESCRIPTION OF THE DRAWING

Figure 1:
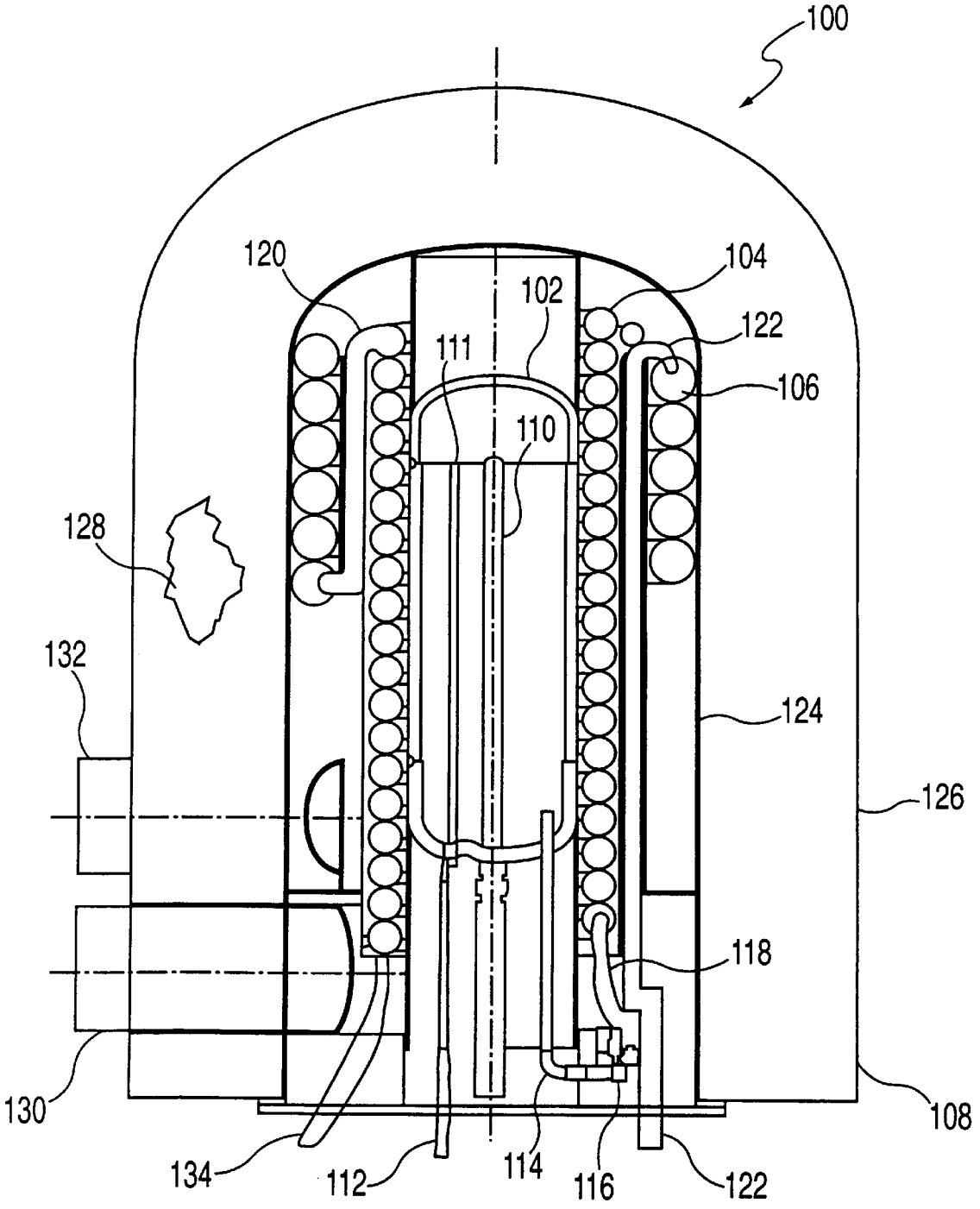
FIG. 1 is a cross-sectional plan view of a continuous power system accumulator assembly constructed in accordance with the principles of the present invention.

FIG. 1 shows an integrated continuous power system vaporizing assembly 100 constructed in accordance with the principles of the present invention. Vaporizing assembly 100 may include accumulator 102, preheater 104 and evaporator 106, that are all contained in assembly housing 108. Accumulator 102 should include accumulator heater 110, which may be, for example, a resistive element that is heated by electricity, or other known heating device. Accumulator 102 also includes fluid level sensor 111 that monitors the level of liquid inside of accumulator 102.

Accumulator 102 is a container for storage of a liquid working fluid that, when required, is vaporized and used to drive a turbine (not shown). As shown in FIG. 1, it may be advantageous for accumulator 102 to be a substantially cylindrical container, such as a tank, that includes working fluid input port 112 and working fluid output port 114. Persons skilled in the art will appreciate that a single working fluid input/output port may be used instead.

The tank for accumulator 102 should be made of a high strength, high temperature, thermally conductive material with a high specific heat, such as steel or other metals, so that thermal energy used to heat the working fluid may also be stored as sensible heat in the container itself. As the working fluid is heated by accumulator heater 110, thermal energy passes from the working fluid to accumulator 102, and then may also be passed to other components of assembly 100 as described more fully below.

Output port 114 is coupled, through turbine start valve 116, to preheater input port 118. Preheater input port 118 provides working fluid from accumulator 102 to preheater 104. Preheater 104 is shown to be a series of coiled tubes (such as finned tubing to allow the transfer of more heat than would be allowed by other tubing) wrapped around accumulator 102. Persons skilled in the art will appreciate that preheater 104 also functions as a source of stored thermal energy in assembly 100. The top of the preheater coils is coupled, through evaporator input port 120, to evaporator 106.

Evaporator 106 is shown to be a series of coils, slightly larger in diameter than the preheater coils, wrapped around the preheater coils. Persons skilled in the art will appreciate that evaporator 106, like preheater 104, also functions as a source of stored thermal energy in assembly 100. The top of the evaporator coils is coupled to evaporator output port 122, which provides superheated vapor to the turbine (not shown).

Moreover, persons skilled in the art will also appreciate that either or both of preheater 104 and evaporator 106, which are shown as helically wrapped tubing, may be arranged in other manners without departing from the spirit of the present invention, provided that they still make use of the waste heat from accumulator 102 and/or preheater 104 to store thermal energy. Persons skilled in the art will further appreciate that, while assembly 100 is shown to include preheater 104 and evaporator 106, only evaporator 106 is required (so that the liquid working fluid is turned into working vapor). It will be understood, however, that the working fluid, which is stored under pressure in accumulator 102, will begin turning to vapor upon release from accumulator 102, even if an evaporator is not used.

Housing 108 is preferably formed from inner wall 124 and outer wall 126, and at least one layer of insulating material, shown generally as reference numeral 128, is contained in the cavity between walls 124 and 126. In addition, it may be advantageous for outer wall 126 to be formed of thermally insulating material to minimize the amount of thermal energy that escapes from assembly 100. The cavity containing preheater 104 and evaporator 106 includes air input port 130 and air exhaust port 132, which are used during LONG-TERM OUTAGES as is described more fully below.

In general, the operation of assembly 100 is as follows. During STAND-BY mode, accumulator 102 is filled with liquid working fluid through input port 112 to a predetermined level (as sensed by level sensor 111). While various working fluids are known to be used with turbines, it may be preferable to utilize toluene, refrigerants, water, or other substances with advantageous thermal and fluid properties, as the working fluid. Accumulator heater 110 heats the liquid working fluid to a desired temperature. Because accumulator 102 is a sealed container, this results in the working fluid being pressurized. Accumulator heater 110 may be an electric heating element or any other suitable device, as set forth above, for transferring heat to the liquid working fluid in accumulator 102.

Input port 112 connects accumulator 102, on one end, to a source of liquid working fluid, such as a condenser or a liquid storage tank (not shown) on the other end. During STAND-BY mode, preheater 104 and evaporator 106 are heated by thermal energy radiating and conducting from accumulator 102, so that energy applied to assembly 100 via accumulator heater 110 performs two functions (the other function being the heating of the liquid working fluid in accumulator 102). Thus, in accordance with the present invention, thermal energy is stored by the working fluid, the housing of accumulator 102, preheater 104 and evaporator 106.

Once an OUTAGE occurs (which can be a complete loss of power or simply a degradation in the quality of power provided by the utility), assembly 100 is switched into RUN mode. In RUN mode, valve 116 is opened and liquid working fluid is transferred out of accumulator 102 via output port 114 and into preheater 104. Preheater 104 continues to heat the already superheated liquid working fluid. After passing through preheater 104, the liquid working fluid is transferred via tube 120 to evaporator 106. Alternately, it is possible that a portion of preheater 104 be directly connected to evaporator 106 in a manner allowing for the direct transfer of liquid working fluid from preheater 104 to evaporator 106.

Evaporator 106 adds additional superheat to the superheated liquid and helps to ensure complete vaporization of the liquid working fluid, thereby enthalpy to the vapor. After passing through evaporator 106, the superheated vapor is transferred via tube 122 to be injected into a turbine (not shown) to drive the turbine. If the OUTAGE continues beyond a predetermined event, such as the level of superheated liquid in accumulator 102 falling below a certain level or after a predetermined amount of time has passed following the opening of turbine start valve 116, an external fuel burning device (not shown) is ignited.

The gases heated by the burner are then input, via port 130, into assembly 100 to further heat preheater 104 and evaporator 106 (the exhaust gas from this process is output via port 132). During RUN mode, additional liquid working fluid is introduced into preheater 104 via input tube 134, which may receive working fluid from, for example, a condenser (not shown), a liquid storage tank, or other similar device.

Whenever thermal or electrical energy is available for the purpose, liquid working fluid is directed back into accumulator 102. The direct flow of liquid working fluid into port 134 may be stopped by a valve so that most, if not all, of the superheated liquid/vapor has evaporated from preheater 104 and evaporator 106 (so that they become substantially dry). After the liquid working fluid in accumulator 102 has returned to its STAND-BY level, it is again sealed and the liquid working fluid is further heated by heater 110 (persons skilled in the art will appreciate that the heating process may occur simultaneous with the refilling process).

Persons skilled in the art will appreciate that the refilling and reheating of accumulator 102 may occur, at least in part, during the OUTAGE while the burner is still operating, thereby adding heat to the restored working fluid in accumulator 102. This acts to reduce the time required to return to STAND-BY mode once utility power returns.

From the foregoing description, persons skilled in the art will recognize that this invention provides for more efficient storage of heat energy that could otherwise be lost from an accumulator in a closed turbine system. It will also be recognized that the invention may take many forms other than those disclosed in this specification. Accordingly, it is emphasized that the invention is not limited to the disclosed methods and apparatuses, but is intended to include variations to and modifications thereof which are within the spirit of the following claims.

We claim:

1. A continuous power system accumulator assembly comprising:

a housing;

a container operable to store liquid working fluid, said container being mounted within said housing;

an energy conversion device mounted in thermal contact with said container, said energy conversion device being operable to convert said liquid working fluid into working vapor; and a heating device mounted in said container, being operable to add thermal energy to said liquid working fluid, said container, and said energy conversion device.

2. The assembly of claim 1, wherein said housing comprises:

an inner wall; and an outer wall.

3. The assembly of claim 2, wherein said housing further comprises:

thermal insulation located between said inner wall and said outer wall.

4. The assembly of claim 1, wherein said energy conversion device comprises:

a material that stores thermal energy.

5. The assembly of claim 1, wherein said heating device is electrically powered.

6. The assembly of claim 1, wherein said liquid working fluid comprises toluene.

7. The assembly of claim 1, wherein said energy conversion device comprises an evaporator.

8. The assembly of claim 7, wherein said energy conversion device further comprises a preheater.

9. The assembly of claim 8, wherein said preheater is in thermal contact with said container and said evaporator is in thermal contact with said preheater.

10. The assembly of claim 1 further comprising:

a source of external heat operable to heat said energy conversion device.

11. The assembly of claim 10, wherein said source of external heat comprises:

a gas burner.

12. An accumulator assembly for use in a continuous power system comprising:

a core comprising:

an accumulator operable to store liquid working fluid;

a preheater located proximally to, and in thermal contact with, said accumulator, said preheater being operable to add enthalpy to said working fluid;

an evaporator located proximally to, and in thermal contact with, said preheater, said evaporator being operable to add enthalpy to said working fluid; and an accumulator heater operable to heat said liquid working fluid, said preheater and said evaporator; and insulating material substantially surrounding said core.

13. The assembly of claim 12 further comprising:

an external housing; and an internal housing, said core being mounted inside said internal housing, said insulating material being located between said internal housing and said external housing.

14. The assembly of claim 12, wherein said preheater comprises:

a material that stores thermal energy.

15. The assembly of claim 12, wherein said evaporator comprises:

a material that stores thermal energy.

16. The assembly of claim 12, wherein said insulating material has openings for at least one tube that transports liquid working fluid into said accumulator.

17. The assembly of claim 12, wherein said accumulator heater is mounted in thermal contact with said accumulator.

18. The assembly of claim 12, wherein said accumulator heater is mounted integrally within said accumulator.

19. The assembly of claim 12 further comprising a source of external thermal energy.

20. The assembly of claim 19, wherein said source of external thermal energy is operable to heat said preheater and said evaporator.

21. The assembly of claim 20, wherein said core further comprises:

a liquid level detector mounted in said accumulator, said detector being operable to monitor the level of said liquid working fluid in said accumulator.

22. The assembly of claim 21, wherein said source of external thermal energy is turned ON when said detector detects that the level of said liquid working fluid has fallen below a predetermined level.

23. The assembly of claim 21, wherein said source of external thermal energy is turned ON when a predetermined amount of time has passed after liquid working fluid begins to flow from said accumulator to said preheater.

24. A method of storing and transferring energy for use in a turbine comprising:

heating an accumulator using an electrical source of heat while utility power is available;

heating an evaporator coupled to said accumulator with thermal energy from said heated accumulator; and heating said evaporator using an external source of heat when an OUTAGE extends beyond a predetermined event.

25. The method of claim 24 further comprising:

transferring thermal energy from said accumulator to a preheater, said transferred thermal energy being radiated and conducted through said preheater to said evaporator.

26. The method of claim 24, wherein heating an accumulator comprises:

heating a liquid working fluid in said accumulator; and heating an accumulator container that stores said liquid working fluid.

27. The method of claim 25, wherein said preheater and said evaporator add enthalpy to said working fluid when utility power is not available, said evaporator outputting working vapor.

28. The method of claim 27 further comprising:

driving a shaft-mounted turbine with said working vapor.

29. The method of claim 28 further comprising:

condensing said working vapor into liquid working fluid;

providing said liquid working fluid to a preheater;

vaporizing said liquid working fluid into working vapor; and driving said shaft-mounted turbine with said working vapor.

30. The method of claim 24, wherein said predetermined event comprises:

when said liquid working fluid stored in said accumulator falls below a predetermined threshold.

31. The method of claim 24, wherein said predetermined event comprises:

when a predetermined period of time has passed since said liquid working fluid.

* * * * *